US007494125B2

(12) United States Patent
Nesis

(10) Patent No.: US 7,494,125 B2
(45) Date of Patent: Feb. 24, 2009

(54) SLIDING TILE PUZZLE WITH TILE ROTATING MECHANISM

(76) Inventor: Dov Nesis, 2 Mohaliver St., Ste. 7, Hertzeliya 46328 (IL)

( * ) Notice: Subject to any disclaimer, the term of this patent is extended or adjusted under 35 U.S.C. 154(b) by 130 days.

(21) Appl. No.: 11/649,122

(22) Filed: Jan. 3, 2007

(65) Prior Publication Data

US 2007/0200292 A1 Aug. 30, 2007

Related U.S. Application Data

(60) Provisional application No. 60/756,403, filed on Jan. 5, 2006.

(51) Int. Cl.
*A63F 9/08* (2006.01)

(52) U.S. Cl. ..... 273/153 S

(58) Field of Classification Search ..... 273/153 S, 273/153 R, 157 R
See application file for complete search history.

(56) References Cited

U.S. PATENT DOCUMENTS

| | | | | | |
|---|---|---|---|---|---|
| 814,653 | A * | 3/1906 | Healey | 273/153 S |
| 1,101,567 | A | 6/1914 | Ridgway | |
| 4,269,414 | A * | 5/1981 | DeVos et al. | 273/153 S |
| 4,422,641 | A | 12/1983 | Collin | |
| 4,451,040 | A * | 5/1984 | Ashley | 273/153 S |
| 4,493,487 | A * | 1/1985 | Ferrigni | 273/153 S |
| 4,548,410 | A | 10/1985 | Morrone | |
| 5,100,142 | A * | 3/1992 | Cannata | 273/155 |
| 5,267,732 | A | 12/1993 | Bowen et al. | |
| 5,529,301 | A * | 6/1996 | Feller | 273/153 S |
| 5,687,970 | A * | 11/1997 | Clark | 273/153 S |
| 5,785,318 | A | 7/1998 | Nesis | |
| 7,063,322 | B2 * | 6/2006 | Safar | 273/153 S |
| 7,243,918 | B2 * | 7/2007 | Vernon | 273/153 S |

* cited by examiner

*Primary Examiner*—Steven Wong
(74) *Attorney, Agent, or Firm*—Robert W. J. Usher

(57) ABSTRACT

A sliding tile puzzle in which a series of rectangular tiles having exposed upper surfaces marked with indicia are packed together in a square planar array for lateral sliding movement in the planar array into a vacant space to change the relative positions of the tiles in the array thereby altering the indicia sequence. Tile turntables are mounted in four corners of the array so that tiles can be slid laterally thereon and are connected by gears to a handle shaft which extends perpendicularly below the array and which can be pushed axially upwards and twisted to raise the corner tiles above the plane of the array and rotate them for return to the array in a changed angular position. Upward movement of the shaft also raised a locking plate into engagement with adjacent tiles to prevent movement thereof.

4 Claims, 4 Drawing Sheets

SLIDING TILE PUZZLE WITH TILE ROTATING MECHANISM

RELATED APPLICATIONS

Priority is claimed from my provisional application 60/756,403 Filed Jan. 5, 2006, the disclosure of which is incorporated herein by reference.

FIELD OF THE INVENTION

The invention relates an amusement device of the sliding tile/block type.

BACKGROUND OF THE INVENTION

Amusement devices of the shifting block type have been in widespread use for more than one hundred years. In one form of such puzzles, a series of rectangular tiles are confined closely packed, side by side in coplanar relation as a generally two dimensional or planar array by a housing frame which also provides a vacant tile admitting or parking space so as to permit sequential lateral coplanar movement of selected individual tiles within the frame in and out of the parking space to change the array, typically to reorder indicia forming a sequence of numbers or letters marked on the exposed surface of the tiles or to change a pattern or picture depicted by the tiles.

Examples of the very numerous puzzles of the type described above are taught by U.S. Pat. No. 1,101,567 issued to Ridgway in 1914; U.S. Pat. No. 4,422,641 issued to Collin in 1983; U.S. Pat. No. 4,548,410 issued to Morrone in 1985 and U.S. Pat. No. 5,267,723 issued to Bowen in 1993, and U.S. Pat. No. 5,785,318 issued 1998 to Nesis.

The structures of the prior sliding tile puzzles, constrain the tiles for translational sliding movement in coplanar relation along orthogonal axes so that indicia marked on the tiles is always positioned in a same direction which imposes an undesirably low limit on the number of different combinations of indicia and therefore the variety of patterns or pictures that can be obtained.

SUMMARY OF THE INVENTION

It is an object of the invention to obviate the above noted limitation by providing an amusement device of the sliding tile type in which one or more individual tiles can be rotated relative to one or more other tiles to change the direction or orientation of indicia thereon thereby increasing the number of different combinations/patterns of indicia.

Another object of the invention is to provide a sliding tile puzzle of the above-noted type in which one or more of the tiles can be shifted controllably out of the plane of the array while remaining linked to the housing to permit said rotation relative to one or more other tiles remaining in the planar array.

The invention provides an amusement device of a sliding tile type in which a series of rectangular tiles having exposed upper surfaces marked with indicia are confined closely packed together, in adjacent, side by side, coplanar relation as a two dimensional array in tile receiving spaces provided by a housing frame which also provides a tile admitting parking space so as to permit sequential lateral coplanar sliding movement of selected individual tiles within the frame in and out from the parking space to change the array, the improvement comprising means for raising at least one tile of the series of tiles perpendicularly out of a plane of the array, clear of adjacent tiles and for rotating said at least one tile to change a direction of indicia thereon and for lowering said at least tile in rotated position back into the array with the indicia in the changed direction.

PARTICULAR DESCRIPTION

Figure 1:
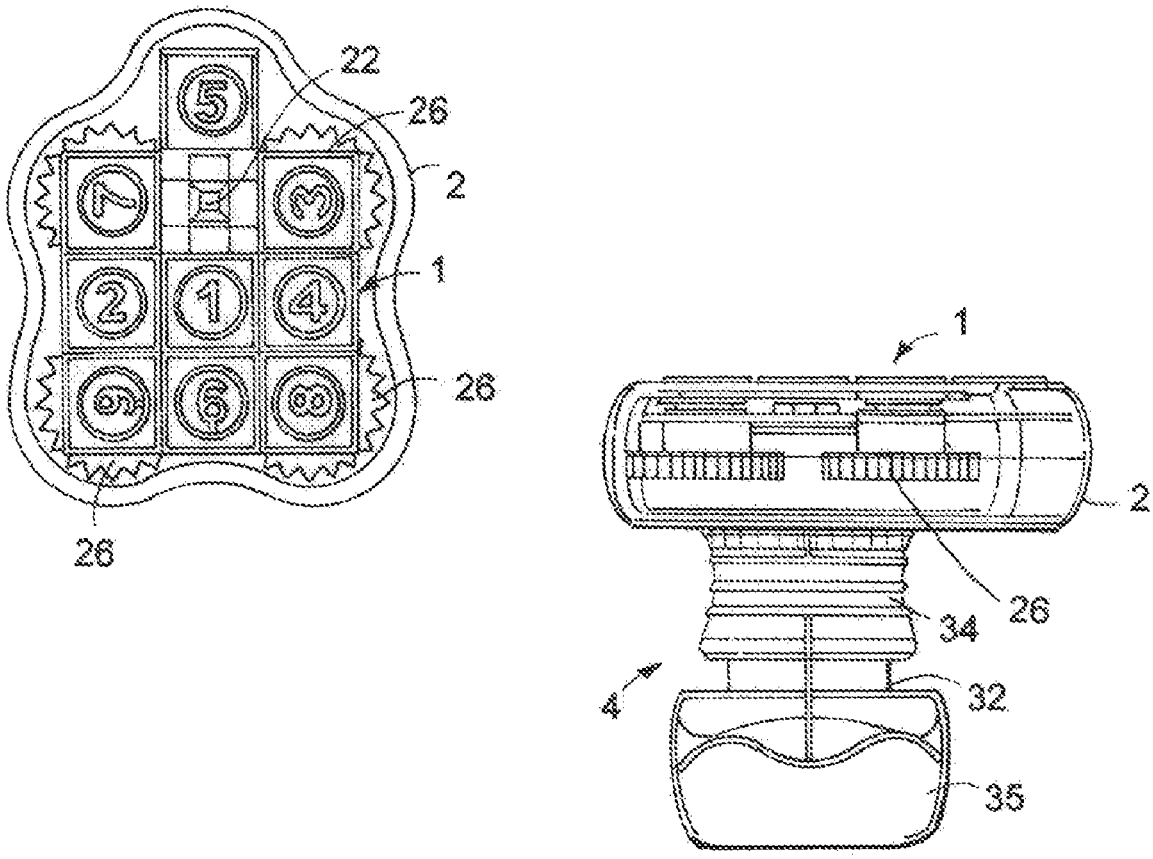
FIG. 1 shows side and top views of an embodiment of puzzle device according to the invention.
Figure 2:
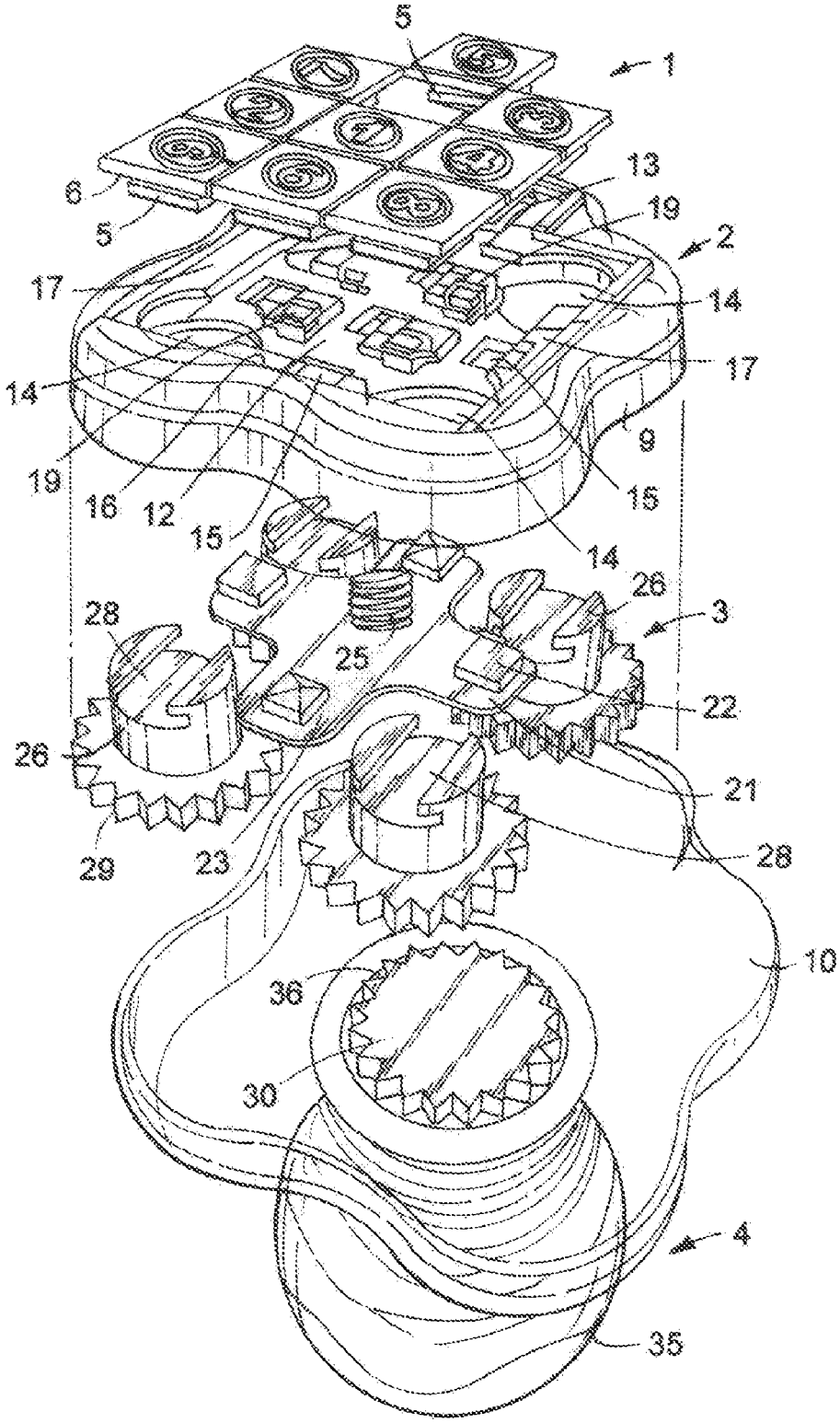
FIG. 2 is an exploded perspective view of the of the puzzle device.
Figure 3:
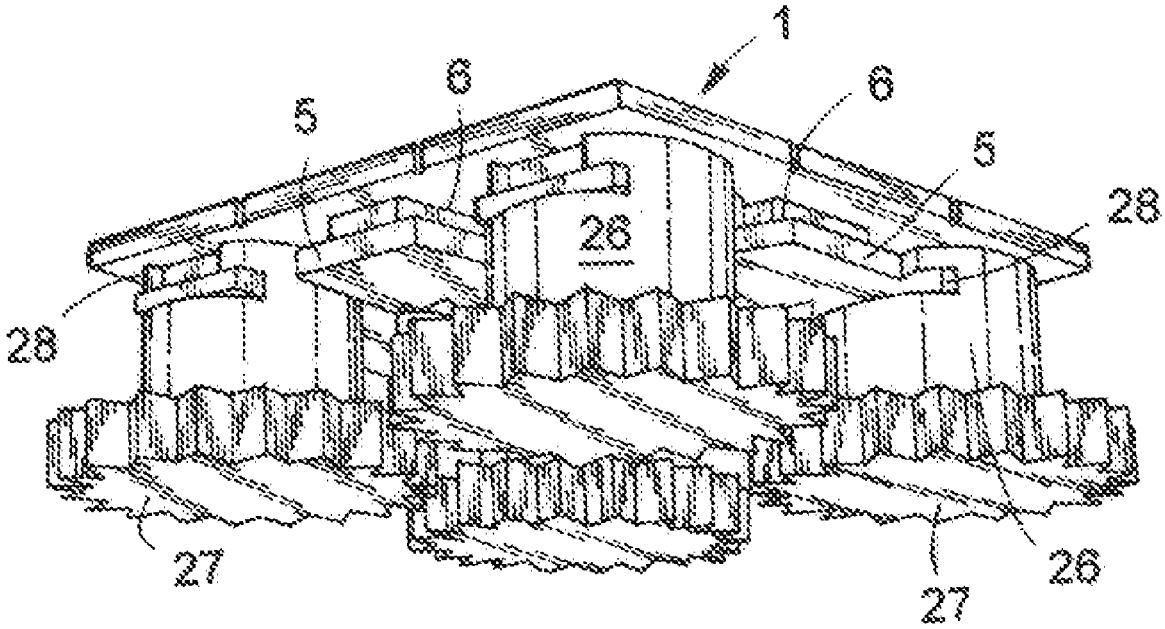
FIG. 3 is a fragmentary perspective view of the underside of the tiles mounted in undercut slots on tile rotating driven gears; and, FIG. 4 (1, 2, and 3) are three views showing the rotation of the four corner tiles through 90 degrees by operation of a push and twist gear mechanism

The sliding tile puzzle device comprises as main elements a matrix array of tiles 1, a tile confining housing assembly 2, a tile raising and rotating mechanism 3 and an operating handle assembly 4.

The tiles 1 have upper exposed faces marked with numerical indicia 1-9, and side edge portions undercut to provide lateral, locating tongues and grooves 5 and 6, and conical locking recesses (not shown) on respective bottom faces.

The housing assembly comprises upper and lower housing halve shells 9 and 10 molded of plastic, respectively, and adhered together along lateral edges. The upper housing half shell 9 comprises a central, recessed tile supporting panel 12 defining a square tile supporting area, corresponding to nine tile spaces and a tenth, offset, tile parking space 13. Circular apertures 14 are formed in tile receiving spaces in each of the four corners of the tile supporting area of the panel 12 and four square apertures 15 are formed in tile receiving spaces between respective apertures for receipt of elements of the tile raising and rotating mechanism 3. The rim 16 of the housing recess is provided with perimetrically spaced apart tile locating lip portions 17 which extend inwards over the perimetrical edge of the panel at locations between the apertures 14 into the respective grooves 6 in adjacent tiles providing rails which retain the tiles in a planar matrix while permitting them to slide over the surface of the panel. Four tile retaining structures 19 also providing lips for receipt in adjacent tile grooves are located in spaced apart relation at a central the location of the panel so that the tiles are retained in the planar array while sliding between them.

The tile raising and rotating mechanism 3 comprises a cruciform tile locking plate 21 having prismatic protuberances with conical tile locking catches 22 on each arm 23 aligned below respective panel apertures 15. A compression spring 25, (possibly optional), is trapped between the center of the locking plate and the underside of the housing panel 12. To provide a downward return force on the tile locking plate 21.

The tile raising and rotating mechanism 3 also comprises four tile rotating turntables 26 each upstanding from a gear 27 and formed at an upper end with an undercut tile locating slot 28. The turntables protrude through respective apertures 14 so that the respective slots 28 slidably receive the locating tongues and grooves 5 and 6 on respective tiles when slid into respective spaces overlying the apertures 14. Each gear 27 has gently conical teeth 29. A common driving gear 30 is aligned centrally of the four driven gears 27 and mounted on the top of a vertical shaft 32 extending coaxially within the handle 34, linked to a return spring, (not shown) and terminating in an operating knob 35. Gear teeth 36 on the driving gear 30 are conical in an opposite sense to the teeth on the driven gears.

Figure 4:
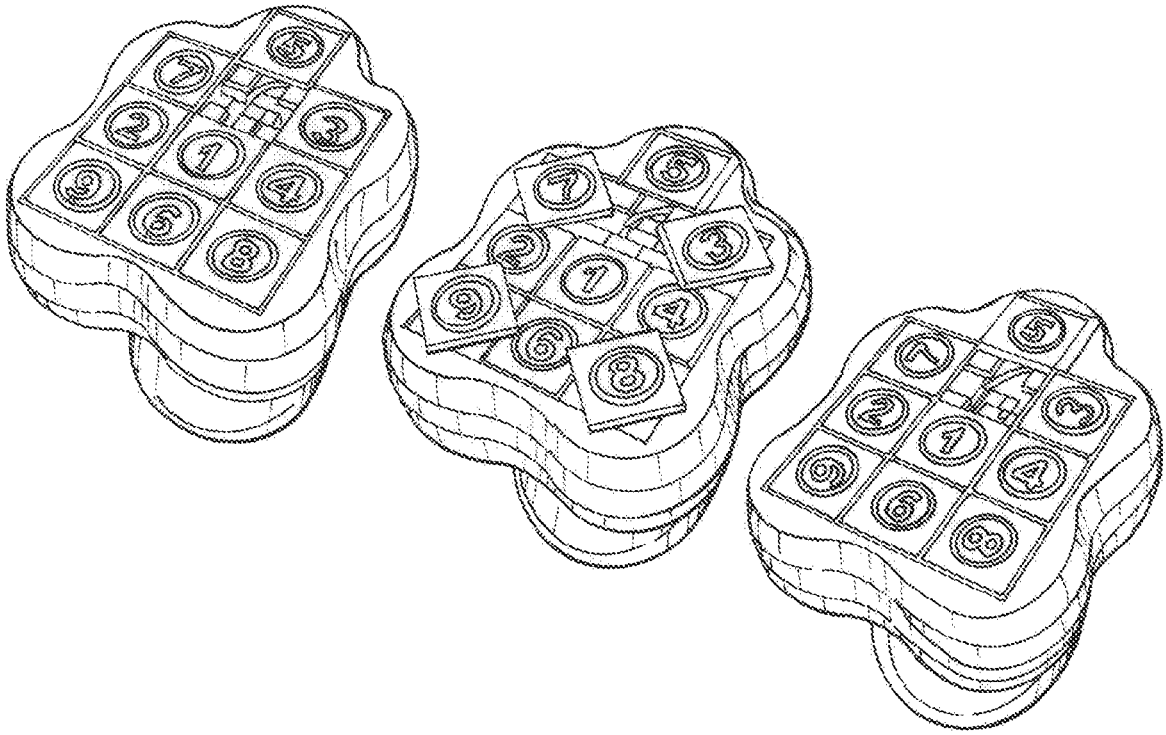

The four corner tiles numbered 3,8,9 and 7 can be rotated through 90 degrees from the indicia direction shown in FIG. 4 [1] to the direction shown in FIG. 4 [3] by pushing up the knob 35, raising the shaft 32 against the action of the return spring and driving gear 30 into full meshing engagement with the driven gear teeth 29, the gently conical shape of the driving and driven gears raising the driven gears and lifting the four corner tiles 3, 8, 9, and 7 perpendicularly above the plane of the tile array 1, clear of adjacent tiles. At the same time the driving gear 36 and pushes up the tile locking plate 21 against the action of return spring 25 so that the tile locking catches 22 enter the recesses on the bottoms of tiles 4, 6, and 2 locking those tiles in the spaces that they occupy. Twisting the knob 35 then rotates the corner through any of 90, 180 270 or 360 degrees, as desired, to redirect the indicia thereon as shown in FIG. 4 [2] and FIG. 4 [3]. When the tiles are correctly realigned with their spaces and adjacent tiles, release of the handle permits the return spring 25 to force the locking plate 21 down, withdrawing the tile locking catches 22 from respective recesses on the bottoms of tiles 4, 6, and 2, unlocking locking those tiles so that they can be slid to adjacent spaces, when vacant, and unmeshing the driving and driven gears, (assisted by the return action of the return spring on the handle).

The aim of the game is to arrange the assembled tiles, to be simultaneously aligned in a predetermined order and indicia direction in relation to each other while overcoming the challenge of the restrictions of the limited sliding direction, of the tiles movement (vertically or horizontally, column or row), that is imposed every time that the player is pushing and rotating the gear handle in 90 degrees steps. Thus, broadly stated, every time the gear rotation takes place in steps of 90 degrees, it will allow the sliding of the tiles in one of two possible directions (row or column, vertically or horizontally). Switching between directions, back and forth, is enabled by subsequent gear rotation of +/−90 degrees.

The invention claimed is:

1. An amusement device of a sliding tile type in which a series of rectangular tiles having exposed upper surfaces marked with indicia are confined closely packed together, in adjacent, side by side, coplanar relation as a two dimensional array in tile receiving spaces provided by a housing frame which also provides a tile admitting parking space so as to permit sequential lateral coplanar sliding movement of selected individual tiles within the frame in and out from the parking space to change the array, the improvement comprising means for raising at least one tile of the series of tiles perpendicularly out of a plane of the array, clear of adjacent tiles and for rotating said at least one tile to change a direction of indicia thereon and for lowering said at least tile in rotated position back into the array with the indicia in the changed direction.

2. An amusement device according to claim 1, wherein the means for raising, rotating and lowering the at least one tile comprises a turntable mounted in a tile receiving space and complementary undercut tongue and groove means are formed on a lower face of said at least one tile and on said turntable engagable by lateral sliding movement of said at least one tile into said space to retain, releasably, said tile on said turntable during the raising, rotating and lowering of said at least one tile.

3. An amusement device according to claim 2 wherein said at least one tile comprises a plurality of said tiles and said means for raising, rotating and lowering the at least one tile comprises a corresponding plurality of turntables mounted in respective, spaced apart, tile receiving spaces, each turntable comprising a driven gear and, further comprising a common driving gear and means for raising said common driving gear into simultaneous operative engagement with the driven gears for simultaneous rotation thereof when the tiles are raised.

4. An amusement device according to claim 3 wherein the housing is mounted on a top of a depending handle and the means for raising said common driving gear comprises a vertical shaft which is rotatively mounted within the handle for limited axial movement in the handle to raise the common driving gear into operative engagement with the driven gear against the action of the a return spring, a knob being provided on the bottom end of the shaft for manual rotation thereof to rotate the common driving gear.

* * * * *